US005394798A

United States Patent [19]

Simon et al.

[11] Patent Number: 5,394,798

[45] Date of Patent: Mar. 7, 1995

[54] OFFSET PRINTING APPARATUS WITH REMOVABLE CASSETTE

[75] Inventors: Pierre Simon, Orleans; Bernard Six, Olivei, both of France

[73] Assignee: Komori-Chambon S.A., Orleans, France

[21] Appl. No.: 257,026

[22] Filed: Jun. 8, 1994

[51] Int. Cl.[6] ..... B41F 31/34

[52] U.S. Cl. ..... 101/218; 101/352

[58] Field of Search ..... 101/350, 351, 352, 349, 101/207-210, 148, 217, 218, 177, 182, 184, 185, 137, 142, 143, 144, 247

[56] References Cited

U.S. PATENT DOCUMENTS 3,323,452 6/1967 Pasquinelli ..... 101/218
3,448,686 6/1969 Bohman ..... 101/349

FOREIGN PATENT DOCUMENTS 1207833 2/1960 France .
1813495 6/1970 Germany .

*Primary Examiner*—J. Reed Fisher
*Attorney, Agent, or Firm*—Young & Thompson

[57] ABSTRACT

This invention relates to an offset printing apparatus, which comprises a frame and a removable cassette comprising a plate cylinder and a blanket cylinder, with parallel transverse axes, tangential to each other and adapted to be engaged in the frame of the apparatus so that the plate cylinder is in contact, under pressure, with each inking roller with a predetermined touch, i.e. a predetermined crushing of the peripheral layer, of supple material, of the inking roller. This touch is determined by a first bearing element or touch way, associated with each bearing of an inking roller and, on each removable cassette, a second bearing element or touch way. In order automatically to obtain the correct touch when a cassette is changed, the second touch way of the cassette is constituted by a fixed disc bearing a covering, forming a coating of thickness equal to that of the covering associated with the plate.

2 Claims, 2 Drawing Sheets

OFFSET PRINTING APPARATUS WITH REMOVABLE CASSETTE

FIELD OF THE INVENTION

The present invention relates to an offset printing apparatus incorporating a removable cassette.

BACKGROUND OF THE INVENTION

Offset printing apparatus incorporating a removable cassette comprise a fixed frame on which are mounted, in particular, an inking device and a dampening device which ensure deposit of a film of ink and water on one or more inking rollers with a peripheral layer of supple material. The ink roller or rollers are themselves mounted to rotate on the fixed frame of the apparatus. Furthermore, such an apparatus uses a removable cassette essentially comprising a chassis on which are rotatably mounted two cylinders of parallel axes, of the same diameter, rotating in opposite directions at the same peripheral speed, namely a plate cylinder and a blanket cylinder, made of supple material, which transfers the print on a web having to be printed. The removable cassette is introduced and housed in the fixed frame so that, when it is completely engaged in this frame, the plate cylinder, i.e. the one which bears the plate used for the print, is in contact with the ink roller or rollers, so as to be able to receive therefrom the ink and the dampening water which are necessary for ensuring offset printing.

Such an offset printing apparatus with removable cassette offers the advantage that it lends itself very well to relatively short series of printing, since it is very easy, when it is necessary to pass from one printing series to another, to replace the cassette used for the preceding printing series by a new cassette appropriate for printing the new series. However, these apparatus pose a problem when one cassette is to be replaced by another, namely that it is necessary, upon each change of cassette, to proceed with a fresh adjustment of the "touch" of the inking rollers on the new plate cylinder placed in position. This "touch", which is necessary in order to obtain a print of good quality, corresponds to the crushing that the supple peripheral layer of each inking roller undergoes in its zone of contact with the plate cylinder, as the two cylinders are applied against one another under a certain pressure. Now, this touch may vary in time for several reasons. In the first place, the diameter of each inking roller may vary in time, due to wear thereof, and such variation in the diameter therefore influences the touch. Secondly, the overall outer diameter of the plate cylinders of different cassettes are slightly different, although the bodies of these cylinders have the same diameter. In fact, a covering of variable thickness is always disposed between each plate and the body of the cylinder, which brings about a slight variation of the outer diameter of the cylinder equipped with its plate. This variation of the outer diameter of the plate cylinder in turn influences the touch between each inking roller and the plate cylinder after the cassette has been placed in position.

It is an object of the invention automatically to obtain, by simple means, after a new cassette has been placed in position, the desired value of the touch between each inking roller and the new plate cylinder pressed thereagainst.

SUMMARY OF THE INVENTION

To that end, this offset printing apparatus with removable cassette, comprising a frame on which are rotatably mounted one or more inking rollers, with a peripheral layer of supple material, with transverse axes, receiving ink and water from respective inking and dampening devices, and a removable cassette comprising a plate cylinder and a blanket cylinder, with parallel transverse axes, tangential to each other, and being able to be engaged in the frame of the apparatus so that the plate cylinder is in contact, under pressure, with each inking roller with a predetermined touch, i.e. a predetermined crushing of the peripheral layer, of supple material, of the inking roller, each plate cylinder comprising a plate wound and fixed around a cylindrical body, with interposition therebetween of a covering of variable thickness, this apparatus comprising, on the frame of the apparatus and on each side of this frame, a first bearing element or touch way controlling a partial adjustment of the touch, associated with each bearing of an inking roller, this first touch way having a first contact surface of which the distance with respect to the axis of the inking roller is adjustable and, on each removable cassette and on each side of this cassette, a second bearing element or touch way controlling another partial adjustment of the touch, associated with each plate cylinder, this second touch way presenting a second contact surface of which the distance with respect to the axis of the plate cylinder is adjustable, the first and second touch ways being disposed so that the respective first and second contact surfaces come into abutment against each other when the cassette is placed in operational position in the frame of the apparatus, thus automatically determining the desired touch between each inking roller and the plate cylinder, is characterized in that the second touch way of the cassette is constituted by a fixed disc bearing, on that part of its peripheral surface which lies opposite the first contact surface, a covering, forming a coating of thickness equal to that of the covering associated with the plate and presenting, on its outer periphery, the second contact surface.

BRIEF DESCRIPTION OF THE DRAWINGS

The invention will be more readily understood on reading the following description with reference to the accompanying drawings, in which.

DESCRIPTION OF PREFERRED EMBODIMENT

Figure 1:
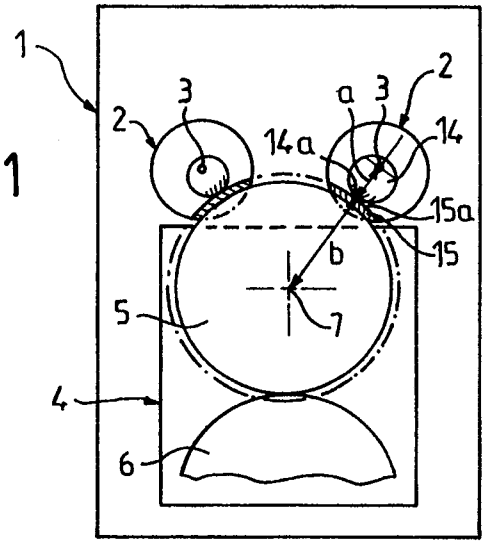
FIG. 1 is a simplified, schematic view in elevation of an offset printing apparatus with removable cassette, according to the invention.

Referring now to the drawings, the offset printing apparatus with removable cassette which is schematically shown, in simplified manner, in FIG. 1, essentially comprises a frame 1 in the upper part of which is rotatably mounted one or more inking rollers 2 with a peripheral layer of supple material, for example rubber. These rollers are mounted to rotate on the frame 1, about pins 3 which extend horizontally and transversely, i.e. perpendicularly to the plane of the sheet of the drawing. These pins 3 are shown schematically, but the inking rollers 2 comprise, in conventional manner, end journals which are rotatably housed in bearings, themselves disposed in the vertical uprights of the frame 1. Naturally, the offset printing apparatus also comprises, in its upper part, inking and dampening devices (not shown) which ensure distribution on the peripheral surface of the inking rollers 2, of films of ink and water, as is necessary for offset reproduction.

The offset printing apparatus 1 furthermore comprises, beneath the inking rollers 2, a removable cassette 4 which comprises a chassis on which are rotatably mounted two superposed cylinders, namely an upper plate cylinder 5 and a lower blanket cylinder 6, made of supple material, which transfers the print onto a web of paper (not shown). The axes of the plate (5) and blanket (6) cylinders are horizontal and transverse, i.e. they extend perpendicularly to the plane of the sheet of drawing, and only axis 7 of the upper plate cylinder is shown. The plate (5) and blanket (6) cylinders are tangential to each other, they rotate at the same peripheral speed, in opposite directions, and they are fast, at their ends, with respective runways 8 and 9 (FIG. 5) which roll on one another in order to maintain fixed the distance between the axes of the two cylinders 5 and 6. The plate cylinder comprises a cylindrical body 11 around which is wound and fixed a plate 12 which is in contact with the inking rollers 2, in order to receive therefrom the films of ink and water necessary for printing. A covering 13 of variable thickness is conventionally located between the plate 2 and the body 11 of the plate cylinder 5.

Figure 2:
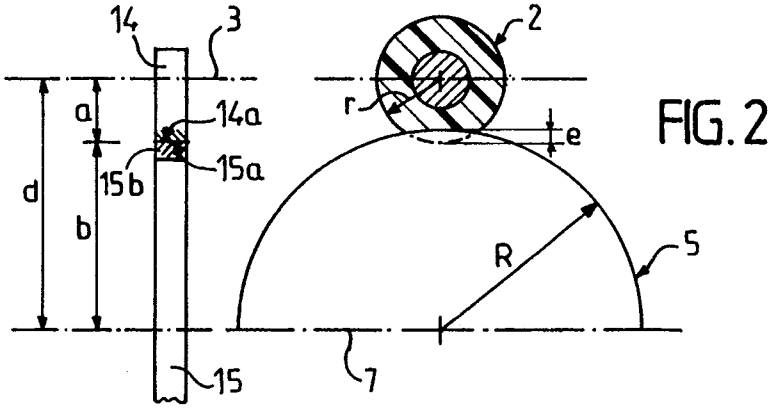
FIGS. 2, 3 and 4 are schematic views illustrating the automatic obtaining of the desired touch in several different cases.

FIG. 2 schematically shows the relative position of an inking roller 2, of radius r, and of the plate cylinder 5, of radius R, of a first cassette, during a printing operation. The two roller/cylinders 2 and 5 are applied under pressure against each other so that the distance d between their respective axes 3 and 7 is less than the sum of the radii r and R. As a result, the superficial layer of supple material of the inking roller 2 is crushed in the zone of contact between the two cylinders 2 and 5 and the value of this crushing e, at the spot where the latter is maximum, corresponds to the "touch" of the two cylinders. This touch e must have an optimum value in order to obtain a high-quality print and it must consequently be adjusted to this value every time a new cassette 4 is placed in the frame 1 of the apparatus.

In order automatically to obtain this optimum value e of the touch, after replacement of one cassette 4 by another, the apparatus comprises, on each side of the frame 1, a first bearing element or touch way 14 which is borne by the frame 1 and which is associated with each bearing of each inking roller 2. This first touch way 14 presents a contact surface 14*a* of which the distance a, with respect to the axis 3 of the inking roller 2, is adjustable. The first touch way 14 may be constituted by any means for varying the distance a and in particular it may be constituted by a cam mounted to rotate on the frame 1, carrying the bearing of the inking roller 2 and of which the peripheral lateral surface constitutes the contact surface 14*a*, by an adjustable bearing screw, by an adjustable sloping shim, i.e. one presenting an inclined ramp, etc. . . . .

Figure 5:
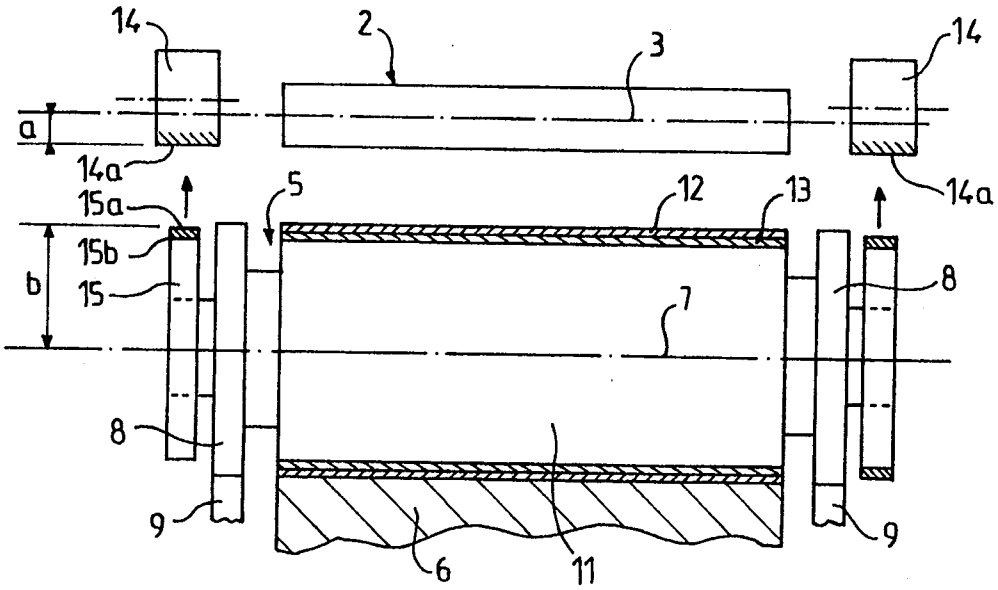
FIG. 5 is a simplified view in transverse section of the offset printing apparatus.

Furthermore, there is provided on each removable cassette and on each side thereof, a second bearing element or touch way 15 presenting a contact surface 15*a* of which the distance b with respect to the axis 7 of the plate cylinder 5 is adjustable. According to the invention, the second touch path 15 is constituted, as shown in FIG. 5, by a fixed disc 15, centered on axis 7 of the plate cylinder 5, whose radius is equal to that of the body 11 of this cylinder and bearing, on that portion of its peripheral surface which is located opposite the contact surface 14*a*, a covering 15*b*, forming a coating with the same thickness as that of the covering 13 interposed between the plate 12 and the cylindrical body 11. To that end, in order to constitute the covering 15*b*, a piece of the covering 13 associated with the plate 12 may be used. The material used for forming coverings 13 and 15*b* is of a conventional type employed with a plate 12. For example, if this material is a sheet of polyester, the covering 15 is formed by a piece of this sheet glued on that part of the lateral surface of the disc 15 which lies opposite the contact surface 14*a*. The outer surface of the covering 15*b* constitutes the contact surface 15*a* of the second touch way 15. The covering 15*b* may in turn be coated with a protective element.

The first and second touch ways 14, 15 are disposed respectively on the frame 1 and on each cassette 4, so that, when cassette 4, with plate cylinder 5 of radius R, has been placed in operational position in frame 1 of the printing apparatus, with inking roller 2 of radius r, their respective contact surfaces 14*a* and 15*a* come into abutment against each other. Consequently, there is automatically obtained a spacing d between axes 3 and 7 of cylinders 2 and 5, which is equal to the sum of the distances a and b, in other words to the sum of radii r and R less touch e, so that this desired touch e is automatically obtained between each inking roller 2 and the plate cylinder 5.

Figure 3:
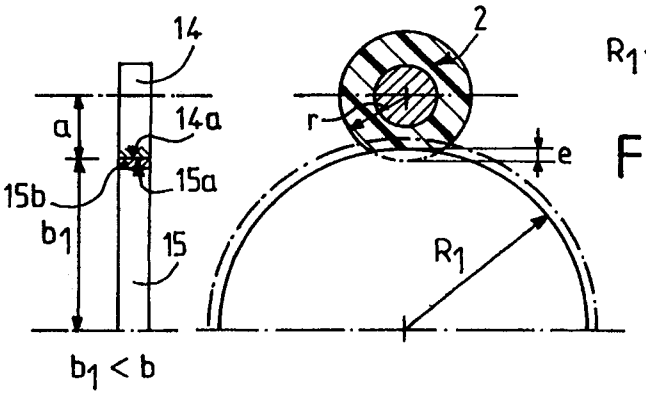

If, in a new cassette having to be used in the printing apparatus, the overall outer radius R1 of the plate cylinder 5 is smaller, further to the use of a covering 13 of smaller thickness, than the value R provided for the preceding cassette, as is schematically shown in FIG. 3, there is applied on the peripheral surface of the disc 15 constituting the second touch way of the new cassette comprising the plate cylinder 5 of radius R1, a covering 15*b* of the same thickness as that of the covering 13, so that its bearing surface 15*a* is then located at a distance b1 from the axis 7 of the plate cylinder 5, which is less than the distance b provided in the case of the cassette of FIG. 2. The difference between distances b and b1 is chosen to be equal to the difference between the radii R and R1 so that, when the cassette bearing the plate cylinder 5 of radius R1 is placed in operational position in the frame 1 of the apparatus, the desired touch e is again automatically obtained between the inking roller 2 of radius r and the plate cylinder 5 of radius R1.

Figure 4:
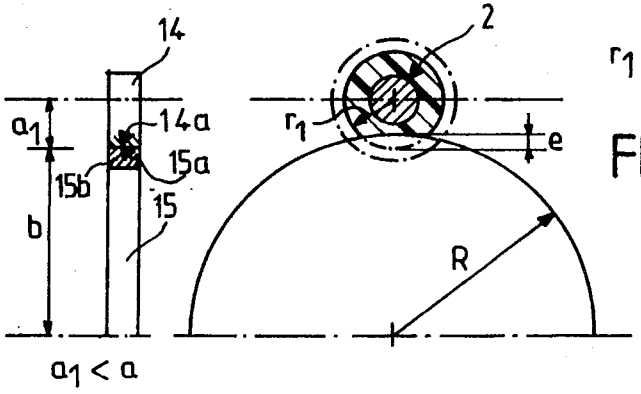

If the radius of the inking roller 2 decreases due to wear thereof, attaining a smaller value r1, as shown in FIG. 4, one then, in order automatically to obtain the desired touch e whenever a cassette is loaded, acts on each first touch way 14 associated, on the frame 1, with each bearing of the inking roller 2, in order to vary distance a. More particularly, the value of the distance a is reduced to obtain a distance a1 which differs from the distance a by the difference between the radius r of the initial inking roller 2 and the radius r1 of the worn inking roller. Consequently, when a cassette 4 bearing a plate cylinder 5 of radius R is placed in operational position in the frame 1, the desired touch e between the plate cylinder 5 of radius R and the worn inking roller of radius r1 is automatically obtained.

It is therefore seen from the foregoing description that the desired touch e between each inking roller 2 and the plate cylinder 5 is automatically obtained, after any cassette is placed in operational position, whatever the degree of wear of the inking roller 2 and whatever the radius of the plate cylinder 5.

What is claimed is:

1. An offset printing apparatus with removable cassette, comprising a frame on which are rotatably mounted one or more inking rollers, with a peripheral layer of supple material, with transverse axes, receiving ink and water from respective inking and dampening devices, and a removable cassette comprising a plate cylinder and a blanket cylinder, with parallel transverse axes, tangential to each other, and being able to be engaged in the frame of the apparatus so that the plate cylinder is in contact, under pressure, with each inking roller with a predetermined touch, i.e. a predetermined crushing of the peripheral layer, of supple material, of the inking roller, each plate cylinder comprising a plate wound and fixed around a cylindrical body, with interposition therebetween of a covering of variable thickness, this apparatus comprising, on the frame of the apparatus and on each side of this frame, a first bearing element or touch way controlling a partial adjustment of the touch, associated with each bearing of an inking roller, this first touch way having a first contact surface of which the distance with respect to the axis of the inking roller is adjustable and, on each removable cassette and on each side of this cassette, a second bearing element or touch way controlling another partial adjustment of the touch, associated with each plate cylinder, this second touch way presenting a second contact surface of which the distance with respect to the axis of the plate cylinder is adjustable, the first and second touch ways being disposed so that the respective first and second contact surfaces come into abutment against each other when the cassette is placed in operational position in the frame of the apparatus, thus automatically determining the desired touch between each inking roller and the plate cylinder, wherein the second touch way of the cassette is constituted by a fixed disc bearing, on that part of its peripheral surface which lies opposite the first contact surface, a covering, forming a coating of thickness equal to that of the covering associated with the plate and presenting, on its outer periphery, the second contact surface.

2. The apparatus of claim 1, wherein the covering is coated with a protective element.

* * * * *